US006520169B1

(12) United States Patent
St. George

(10) Patent No.: US 6,520,169 B1
(45) Date of Patent: Feb. 18, 2003

(54) WEAPON FOR CENTRIFUGAL PROPULSION OF PROJECTILES

(75) Inventor: Charles W. St. George, Avon, CT (US)

(73) Assignee: Trinamic Technologies, LLC, West Hartford, CT (US)

( * ) Notice: Subject to any disclaimer, the term of this patent is extended or adjusted under 35 U.S.C. 154(b) by 81 days.

(21) Appl. No.: 09/795,807

(22) Filed: Feb. 28, 2001

Related U.S. Application Data

(60) Provisional application No. 60/185,843, filed on Feb. 29, 2000.

(51) Int. Cl.[7] ..... F41B 3/04
(52) U.S. Cl. ..... 124/6
(58) Field of Search ..... 124/6, 45, 48, 124/51.1, 82

(56) References Cited

U.S. PATENT DOCUMENTS

| | | | | |
|---|---|---|---|---|
| 1,049 A | | 12/1838 | McCarty | |
| 15,529 A | | 8/1856 | Smith et al. | |
| 1,201,626 A | | 10/1916 | Reynolds | |
| 1,223,069 A | | 4/1917 | Porter | |
| 1,240,815 A | | 9/1917 | Brown | |
| 1,284,999 A | | 11/1918 | Blair | |
| 1,309,129 A | | 7/1919 | Gannoe | |
| 1,332,992 A | | 3/1920 | Moore et al. | |
| 1,357,028 A | | 10/1920 | Case | |
| 1,404,378 A | | 1/1922 | Czegka | |
| 1,408,137 A | | 2/1922 | Parsons | |
| 1,420,660 A | | 6/1922 | Lombard | |
| 1,472,080 A | | 10/1923 | McNaier | |
| 1,662,629 A | | 3/1928 | Baden-Powell | |
| 1,986,836 A | | 1/1935 | MacNeille | |
| 2,043,117 A | | 6/1936 | Baden-Powell | |
| 2,391,636 A | | 12/1945 | McArthur | |
| 2,684,062 A | * | 7/1954 | Rose | 124/6 |
| 3,177,862 A | | 4/1965 | Allemann | |
| 3,613,655 A | | 10/1971 | Tobin et al. | |
| 4,463,745 A | | 8/1984 | Acker | |
| 4,607,605 A | | 8/1986 | Rutten | |
| 4,632,086 A | * | 12/1986 | Rutten | 124/6 |
| 5,819,715 A | | 10/1998 | Haneda et al. | |

FOREIGN PATENT DOCUMENTS

| | | | | |
|---|---|---|---|---|
| DE | 635947 | | 9/1937 | |
| IT | 329550 | * | 9/1935 | 124/6 |

* cited by examiner

*Primary Examiner*—John A. Ricci

(57) ABSTRACT

A weapon for centrifugally discharging projectiles at a rapid rate comprising a housing in which is rotatably mounted a disc having a multiplicity of feed channels extending radially therein. Each of the feed channels receives a multiplicity of projectiles and is configured to orient the projectiles in a single file adjacent the disc periphery of the disc projectile locking means. Each of the channels has located adjacent the periphery disc a multiplicity of stops movable between a first position within the channel to preclude movement of the outermost projectile outwardly of the channel and a second position removed from the channel to permit movement of a projectile thereby. Locking cams move the stops between the first and second positions, and other came actuate the locking cams as the disc rotates to move the outermost stop into the second position and release the outermost projectile while the adjacent stop restrains the adjacent projectile, which is thereafter released to move outwardly until restricted by the first stop. The projectiles are released into a guide rail extending substantially about the periphery of the disc and the guide having a discharge opening therein.

10 Claims, 10 Drawing Sheets

WEAPON FOR CENTRIFUGAL PROPULSION OF PROJECTILES

This application claims benefit of Provisional Application No. 60/185,843, filed Feb. 29, 2000.

BACKGROUND OF THE INVENTION

The present invention relates to automatic weapons using centrifugal force to propel projectiles.

A gradual evolution in small caliber weapons development has occurred over the last 20 years with the emphasis being towards high rates of fire, saturation fire in the general direction of the perceived enemy position and the ever increasing awareness of the need to ensure the weapon crew survivability during missions. Prolonged saturation fire exposes the weapon crew to return fire from the enemy which detects their position.

Weapons that use centrifugal force instead of an explosive powder propellant for launching the projectiles have been known in the prior art. One type of centrifugally operated gun involves straight radially extending barrels such as those shown in McNaier U.S. Pat. No. 1,472,080 and Allemann U.S. Pat. No. 3,177,862. A limitation of such a construction is that the power required to rotate the radial barrel is too great to develop an economically feasible rapid fire weapon. In Allemann U.S. Pat. No. 3,177,862, radial gun barrels are incorporated within the helicopter blades which would slow down the speed of rotation of the blades due the absorption of energy by the projectile as the projectiles pass through the barrels.

Another type of centrifugal gun includes a gun barrel having an arcuate rather than radial construction. Such construction, however, has limited the speed of the projectiles for various reasons including (i) rotation of the bullet in a direction reverse to travel direction of the projectile and (ii) the provision of a peripheral barrier which prevents emission of the projectile at the precise moment that it achieves its maximum speed at the exit end of the barrel. Illustrative of such weapons are Brown U.S. Pat. No. 1,240,815, Blair U.S. Pat. No. 1,284,999, Parsons U.S. Pat. No. 1,408,137 and Baden-Powell U.S. Pat. No. 1,662,629.

Associated with the foregoing type of gun has been the problem of overcoming the strong gyroscopic reaction force of a rotating impeller that resists turning and moving a gun when aiming in a plane that is not perpendicular to the axis of rotation of the impeller. One solution proposed in Tobin U.S. Pat. No. 3,613,655 is to provide a first impeller which rotates clockwise to offset the second impeller which rotates counterclockwise and thereby nullify the gyroscopic reaction.

Most prior art weapons have relied upon gravity feed of the projectiles through a hopper design with some form of screw device to aid projectile movement into desired channels or barrels. Such gravity feed loading systems are not able to feed the desired amount of projectiles in any centrifugal operated weapon at high speeds since the rotating member that provides the centrifugal force to propel the projectiles expels the projectiles much faster than any gravity feed loading system can supply. Thus, the rate of fire of these weapons is restricted by having the rate of fire controlled by gravity fed loading systems.

It is an object of the present invention to provide a novel automatic weapon utilizing centrifugal force which provides both a high rate of discharge (rounds per minute) and high muzzle velocity.

It is also an object to provide such an automatic weapon which operates in a continuous stealth mode to increase its operational capabilities and the survivability of the weapon crew.

Another object is to provide such a weapon which effectively eliminates overheating, jamming, the need for synchronized feeding and peripheral discharge, and any requirement for mechanical compensation for possible gyroscopic reaction.

A further object is to provide such a weapon which has the capability of firing thousands of rounds per minute at high velocities with a continuous supply of projectiles and without the need for feed to fire synchronization, and without incorporating some form of gyroscopic control system and some form of balancing device.

SUMMARY OF THE INVENTION

It has now been found that the foregoing and related objects may be readily attained in a weapon for centrifugally discharging projectiles at a rapid rate comprising a housing in which is rotatably supported a disc having a multiplicity of feed channels extending radially therein and opening at the periphery of the disc. The feed channels receive a multiplicity of projectiles and are configured adjacent the periphery of the disc to orient the projectiles in a single file. Projectile locking means are associated with each of the channels and are located adjacent the periphery of the disc. The locking means includes a multiplicity of stops movable between a first position within the channel to preclude movement of the outermost projectiles outwardly of the channel and a second position removed from the channel to permit movement of a projectile thereby and for moving the stops between the first and second positions.

The weapon also includes means for actuating the moving means as the disc rotates to move the outermost stop into the second position and release the outermost projectile while the adjacent stop restrains the adjacent projectile and thereafter the actuating means releases the adjacent stop to allow the next projectile to move outwardly until restricted by the first stop which has moved back into the first position thereof. The projectiles are discharged from the channels into a guide rail in the housing extending substantially about the periphery of the disc and it has an opening therein to allow the projectiles entering therein to be discharged. Also provided are motor means for rotating the disc, and control means for the motor means.

Preferably, there are at least three stops in each channel to position three projectiles and the moving means releases the outermost projectile and allows the next two projectiles to move outwardly to the next stop. Desirably, the stops are rollers in apertures communicating with the channel and movable upwardly and downwardly between the first and second positions.

The moving means includes at least one locking cam movable axially of the channel to effect movement of the stops between the first and second positions. The moving means also includes cam members acting upon the locking cam. The actuating means is located at a point spaced from the opening in the guide rail to release the outermost projectile sequentially from the channels as the disc rotates thereby.

In one embodiment, there are replaceable tubes in the channels in which projectiles are preloaded.

In another embodiment, the disc has a feed aperture in its center and the feed channels extend between the feed aperture and the periphery of the disc. A feed mechanism is disposed above the feed aperture and has feed passages alignable with the channels in the disc for passage of projectiles into the feed channels. The feed mechanism is engageable with the disc to rotate therewith, and the control means reduces the rotational speed of the motor and disc during feeding of projectiles into the feed channels.

DETAILED DESCRIPTION OF THE ILLUSTRATED EMBODIMENT

Figure 13:
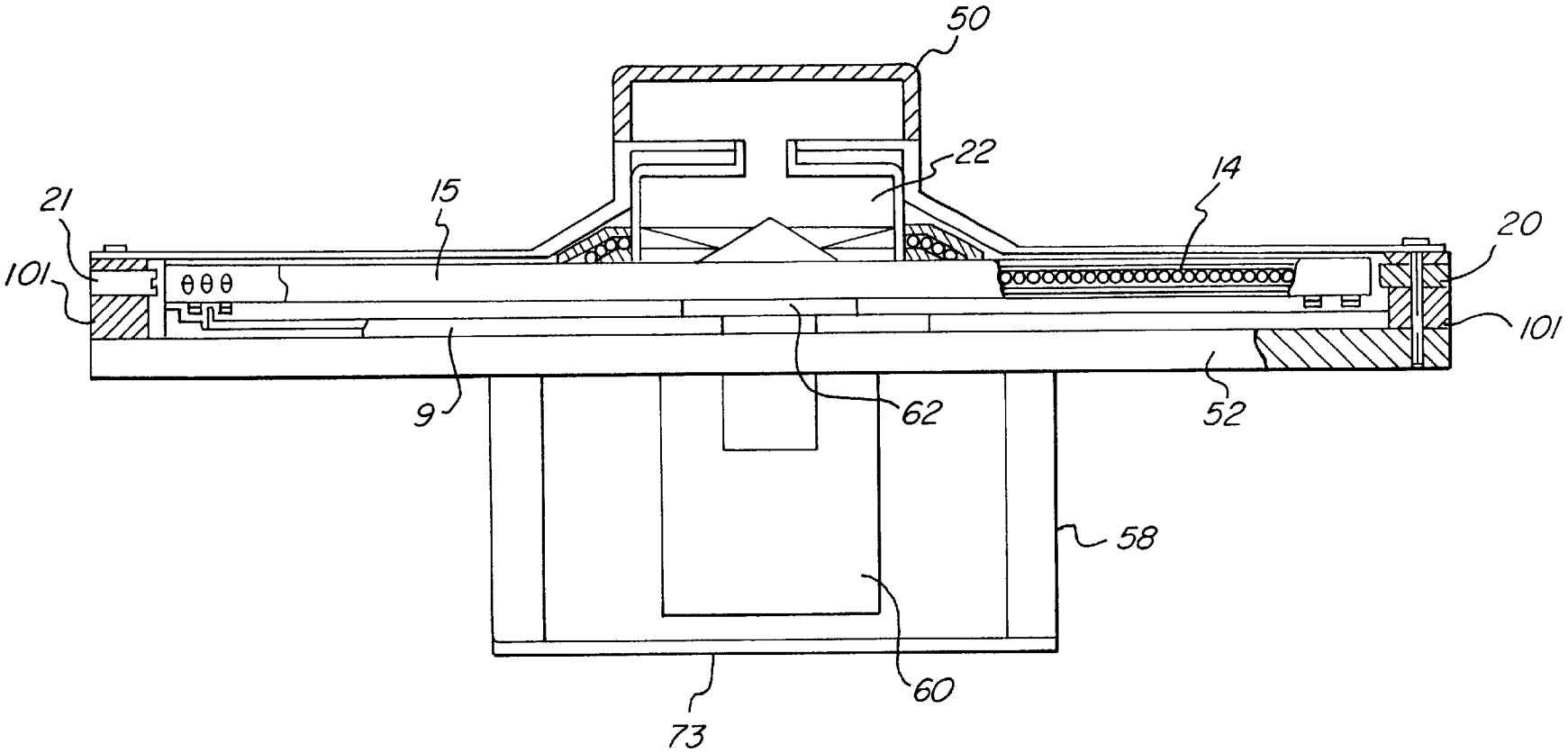
FIG. 13 is a diagrammatic sectional view of a weapon embodying the present invention.
Figure 14:
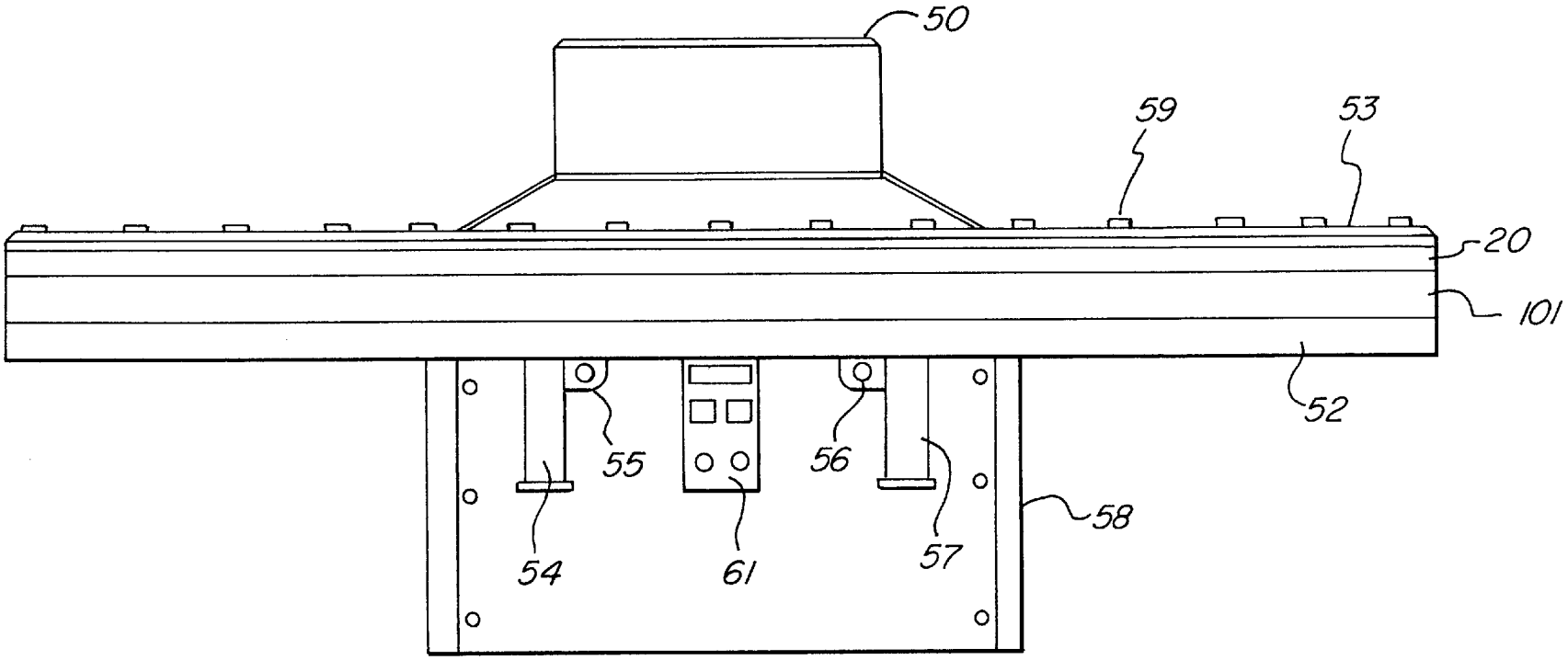
FIG. 14 is an elevational view thereof.

Turning first to FIGS. 13 and 14, therein illustrated is a weapon embodying the present invention and generally comprised of a housing 50 with a motor base plate 73 and struts 58, supporting a base plate 52. Above the plate 52 are a generally annular circumferential ring 101 and the rotor generally designated by the numeral 15 spaced about the rotor 15 are radially extending channels 14 in which are disposed projectiles generally designated by the numerals 1–5. A cover plate 53 is disposed over the rotor 15 and ring 101, and it is secured to the base plate 52 by the fasteners 59. An electric motor 60 is disposed within the housing 50 and its shaft 62 is coupled to the rotor or disc 15 to effect rotation thereof.

As seen in FIG. 14, an electronic control 61 is provided to regulate the motor 60, and switches 55 and 56 are provided to control the firing action. Disposed above the rotor assembly 15 is a feeder generally designated by the numeral 22. As also seen in FIG. 14, the weapon can be carried and manipulated by the hand grips 54,57.

Figure 1:
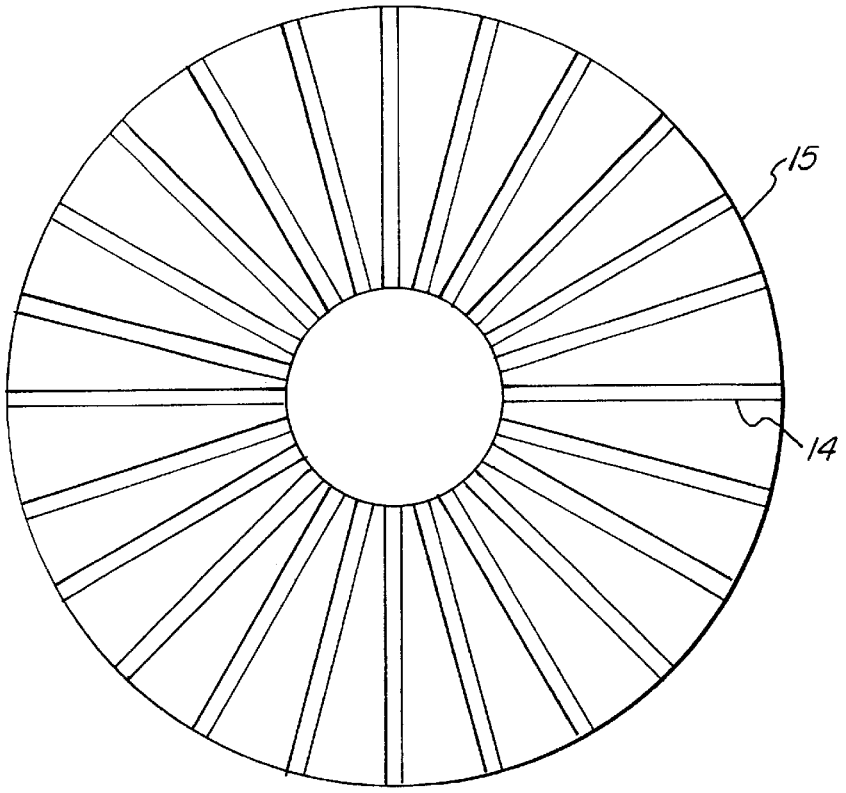
FIG. 1 is a plan view of the rotor or disc with its channels in which the projectiles are initially received.
Figure 2:
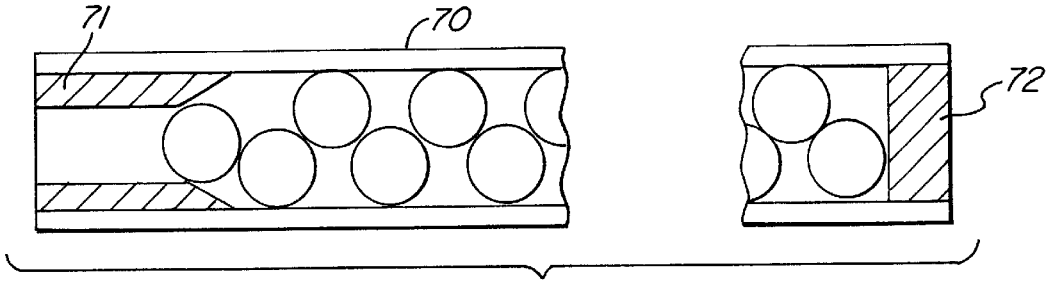
FIG. 2 is a fragmentary sectional view of a loaded feed tube which may be used in the disc.

Turning first in detail to the rotor or disc 15 as seen in FIGS. 1 and 2, it can be seen that the disc is annular with a series of 20 feed channels 14 extending radially outwardly from the center opening to the circumference thereof. In FIG. 2, there is illustrated a replaceable feed tube 70 with a stopper 72 at its inner end and a continuation of the feed channel 71 at the outer end.

Figure 3:
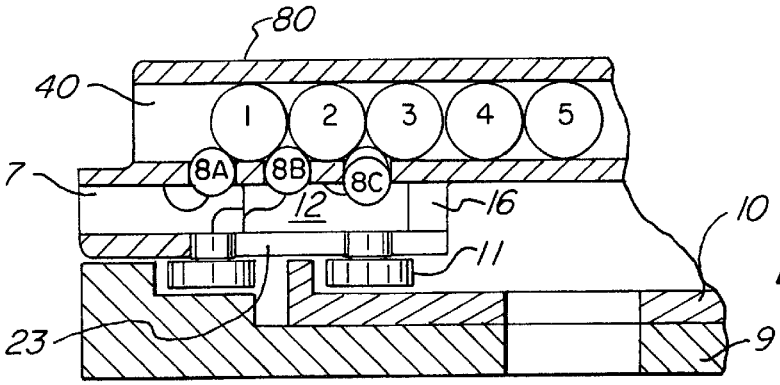
FIG. 3 is a fragmentary diagrammatic view showing the locking assembly with a projectile ready to be fired.

Turning next to FIG. 3, therein illustrated is a fragmentary view of the locking assembly member 80 having a cylindrical passage 40 in which are disposed five projectiles bearing the numerals 1–5. As can be seen, the lower wall portion of the passage 40 has a series of three apertures therein in which are movably seated rollers 8*a*, 8*b* and 8*c*. Located below the locking assembly member 80 are the ring cams 9 and 10 which are slidable relative to each other on the base plate 52. Slidable in a channel 16 below the rollers 8 are a pair of locking cams 7 and 12 with recesses in their upper surfaces and they are coupled to bearing elements 6 and 11 which are slidable in an axially extending slot 23. As a result of relative movement of the ring cams 9,10, the lips thereon will bear against the bearings 6 and 11 to effect relative movement of the locking cams 7 and 12. As a result, when a recess in the upper surface of a locking cam 7,12 is aligned with a roller 8, the roller 8 is free to be forced downwardly into that recess by the projectile being urged outwardly by centrifugal force, thus allowing the projectile to pass thereby.

In the position of the elements seen in FIG. 3, the locking roller 8*a* has been cammed upwardly so as to provide a stop for the outermost projectile 1. Similarly, the roller 8*b* has been forced upwardly by the locking cam 12 so that it provides a stop for the projectile 2.

Figure 4:
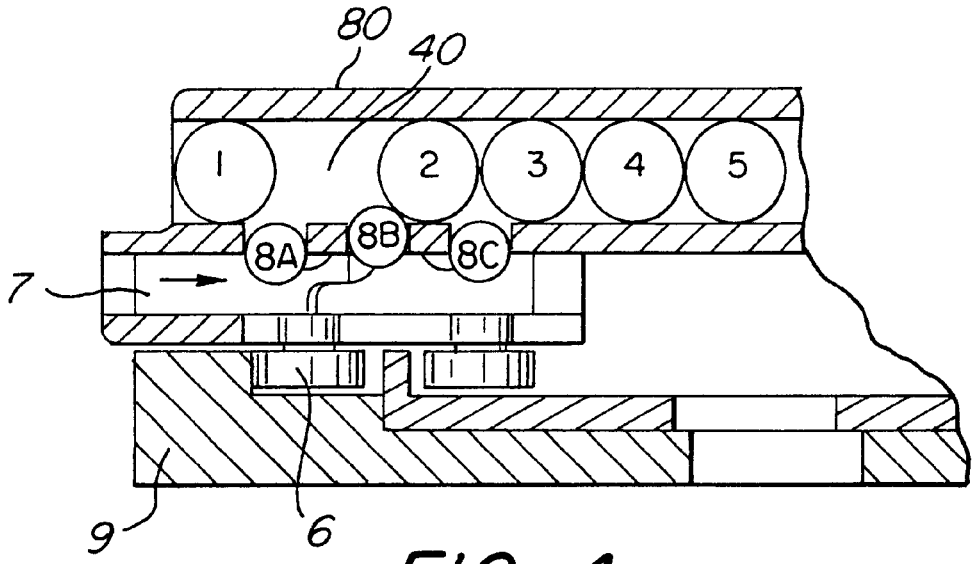
FIG. 4 shows the locking assembly after releasing a projectile.

Turning now to FIG. 4, the locking cam 7 has been moved to the right as shown by the arrow, and this has allowed the projectile 1 to push the roller 8*a* downwardly into the recess the locking cam 7 and thus pass thereby. However, the roller 8*b* remains in an elevated position preventing movement of the projectile 2 thereby.

Figure 5:
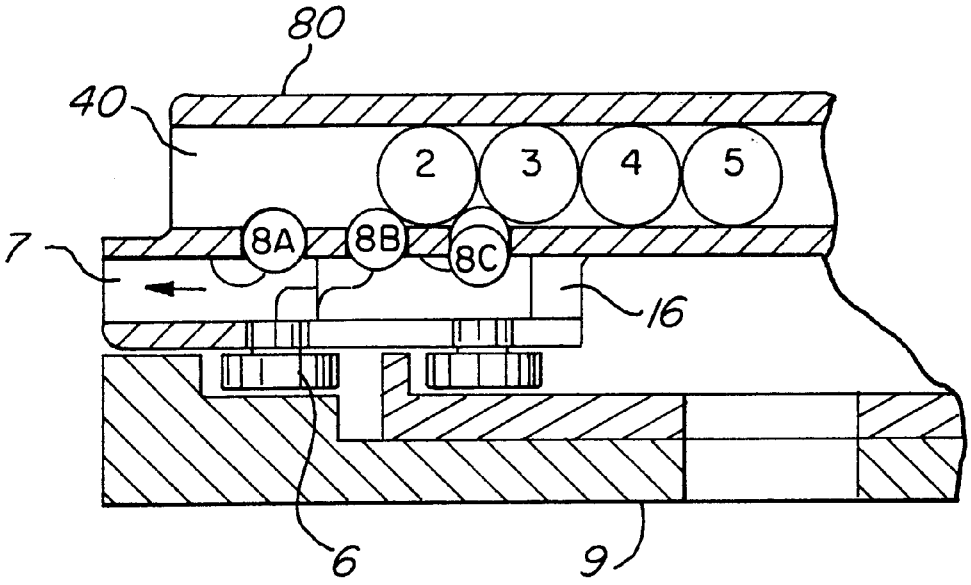
FIG. 5 shows the locking assembly in position to prevent the release of the second projectile in line.

Turning next to FIG. 5, the cam 9 is being urged to the left as shown by the arrow causing the roller 8*a* to be urged upwardly by the movement of the locking cam 7.

Figure 6:
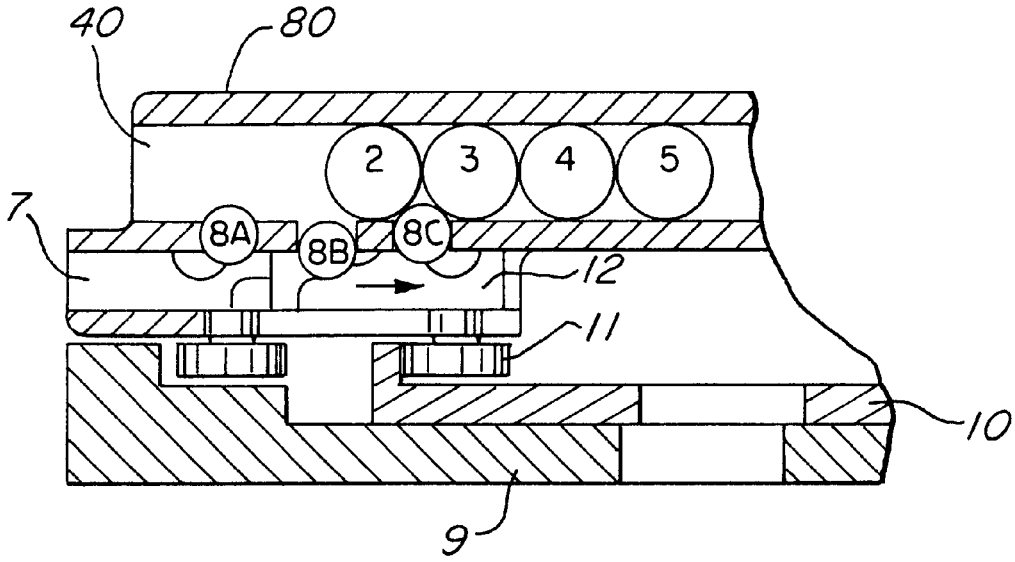
FIG. 6 shows the locking assembly positioned to allow partial forward movement of the second projectile to the position previously occupied by the first projectile.

In FIG. 6, the cam 10 is being urged to the right as shown by the arrow, and this has caused the locking cam 12 to be moved to the right. As a result, the roller 8*b* has moved downwardly under pressure from the projectile 2, in this position, the projectile 2 may pass thereover until it abuts the roller 8*a* which is again in the elevated stop position. The roller 8*c* has also been urged upwardly into the stop position to prevent movement of the projectile 3.

Figure 7:
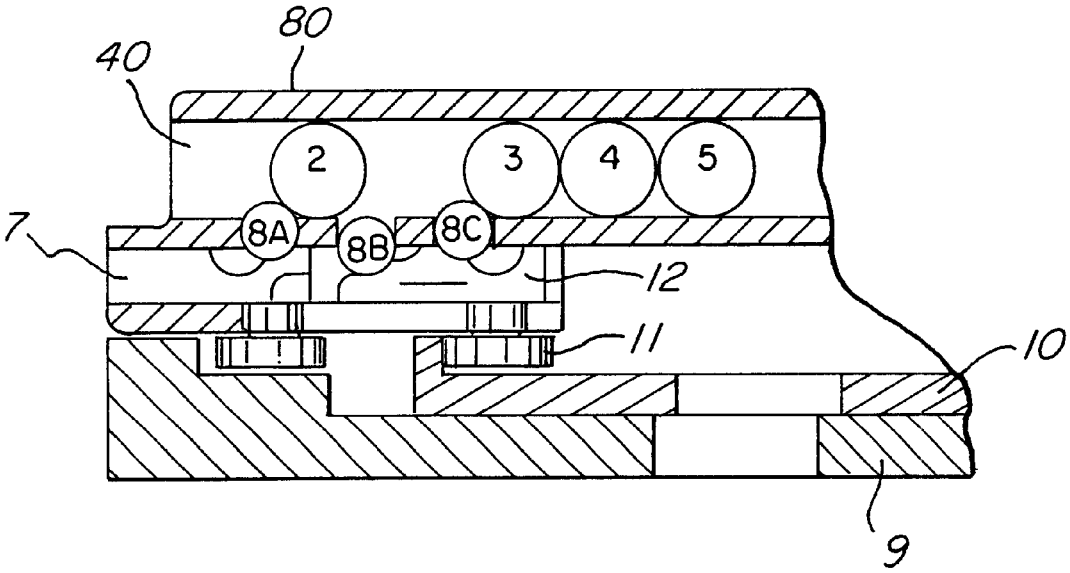
FIG. 7 shows the locking assembly with a projectile ready to be fired and before the next projectile is freed to move into the second position as depicted in FIG. 4.

In FIG. 7, it can be seen that the projectile 2 has moved outwardly until it has been stopped by the roller 8*a*. During continued rotation of the disc 15, rotary cam 10 will be urged in the opposite direction, allowing projectile 3 to force roller 8*c* into a recess in the locking cam 12 and roller 8*b* will be forced upwardly to preclude its movement beyond roller 8*b*.

Turning next to FIGS. 10 and 16*a*, 16*b* and 16*c*, the ring cams 9 and 10 are slidably supported on the base plate 52 and the two cams have essentially circular apertures 24, 25 therein. Extending therein is an actuator 96 having cam elements 90 and 91 which are axially spaced thereon. As can be seen, the actuator 96 is radially offset from the center of the circular apertures 24, 25 in the cams 9 and 10. As a result, during rotation of the cams 90 and 91, they will engage the surface of the rotary cams 9 and 10 and effect movement thereof on the base plate 52.

As previously indicated with respect to FIGS. 3–7, the movement of the rotary cams 9 and 10 effects motion through their action upon the bearings 6 and 11 to move the locking cams 7 and 12. Thus, this provides the controlled release of the projectiles travelling in the channels 14.

Figure 15:
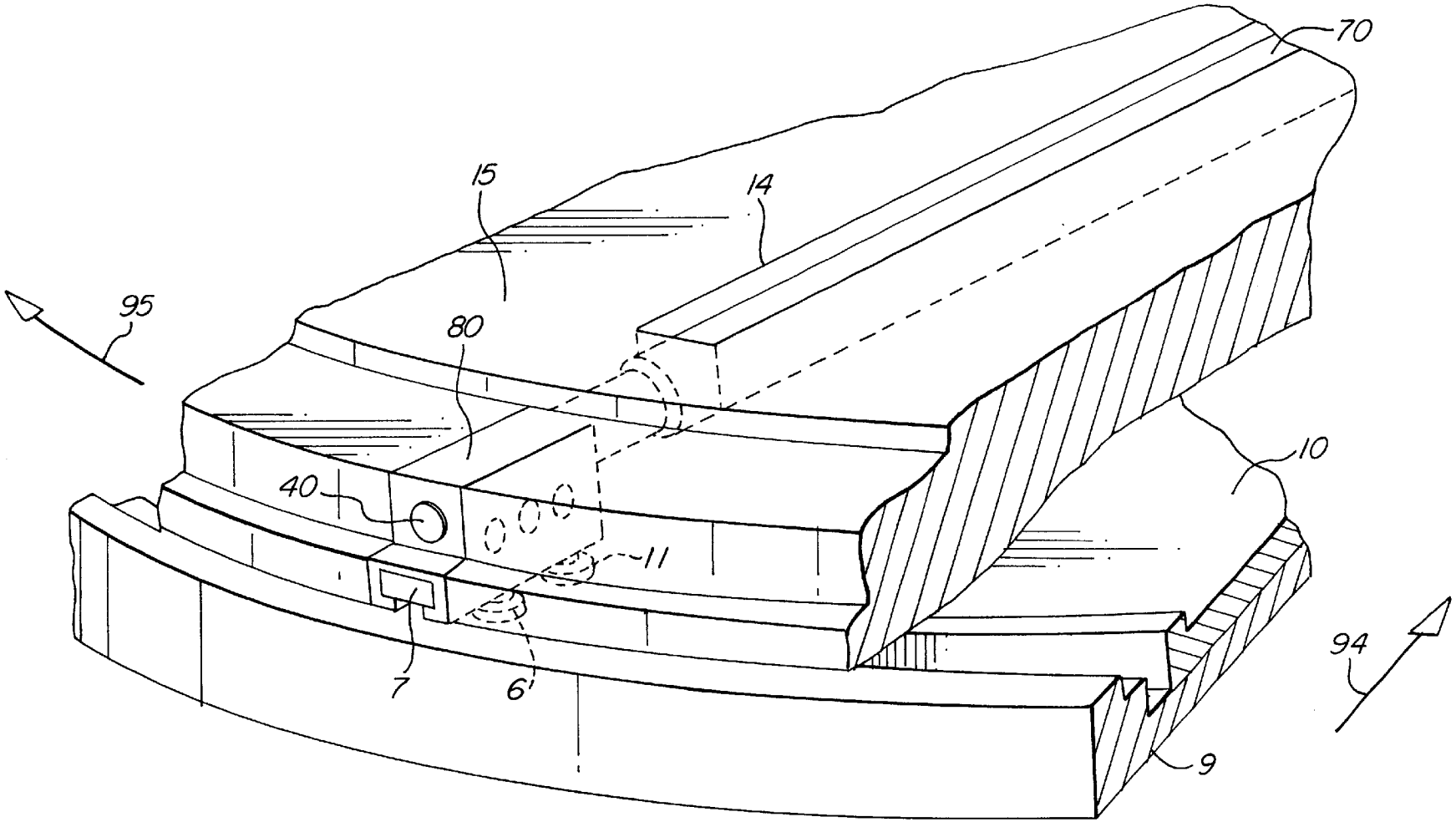
FIG. 15 is a fragmentary perspective view of the disc and cam members.
Figure 16A:
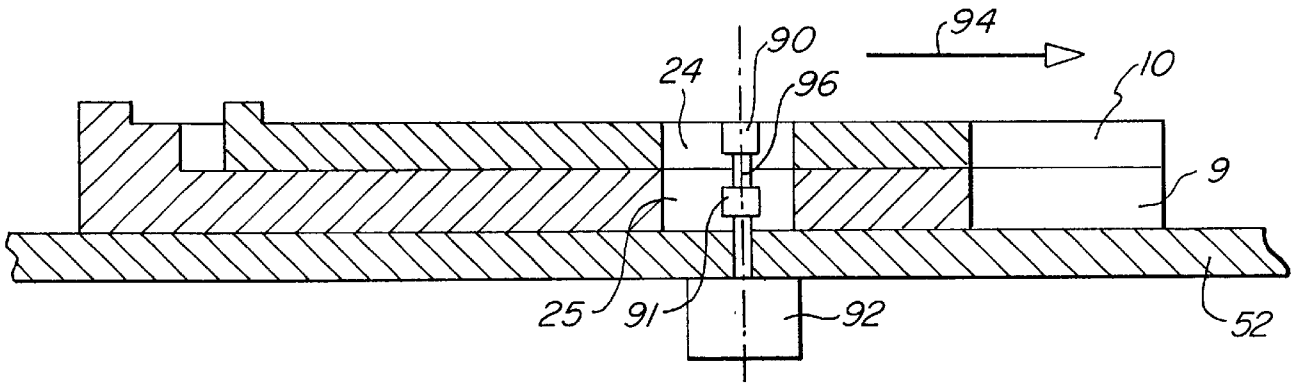
FIG. 16*a* is a sectional view of the cams and actuator.
Figure 16B:
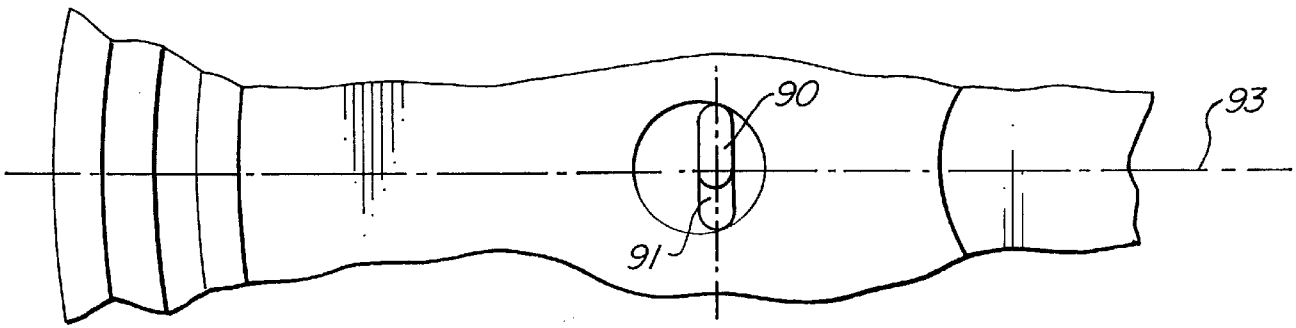
FIG. 16*b* is a fragmentary plan view of the cams and actuator.
Figure 16C:
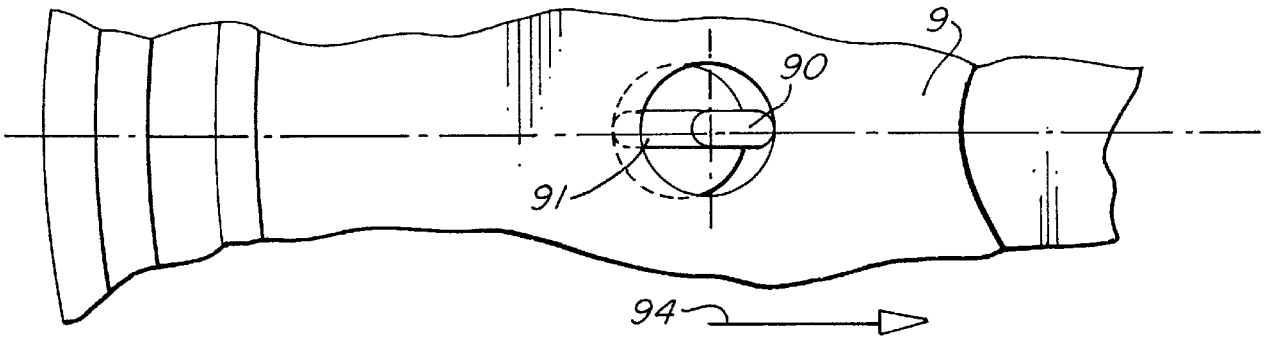
FIG. 16*c* is a similar view with the actuator rotated 90°.

As best seen in FIG. 15, the locking assembly member 80 is disposed at the end of the channel 14 and provides the terminal portion of the feed channel 14, and it contains the roller stops 8 and the locking cams 7 and 12. FIG. 15 also illustrates the manner in which the bearings 6 and 11 seat relative to the lips on the rotary cams 9 and 10.

FIG. 15 also illustrates a tube housing 70 which is filled with projectiles. This tube housing 72 can be inserted in the appropriate channel formed in the disc 15. For example, with a properly dimensioned tube as seen in FIG. 2, the projectiles can be staggered within the tube and approximately 50 projectiles can be stored in a length of eight inches. Multiplying 50 projectiles in a single tube by the 20 channels in the illustrated embodiment indicates that a total of 1,000 projectiles are available without recharging.

Figure 8:
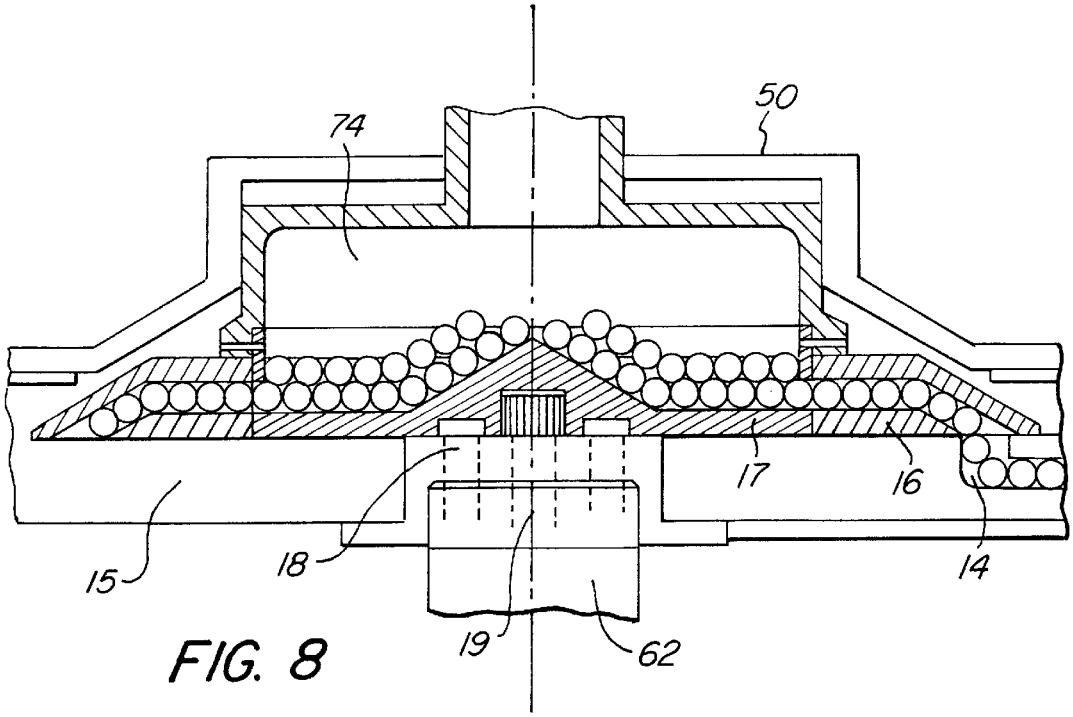
FIG. 8 shows a central feeding system engaged with the disc to feed projectiles to the channels in the disc while it is rotating.
Figure 9:
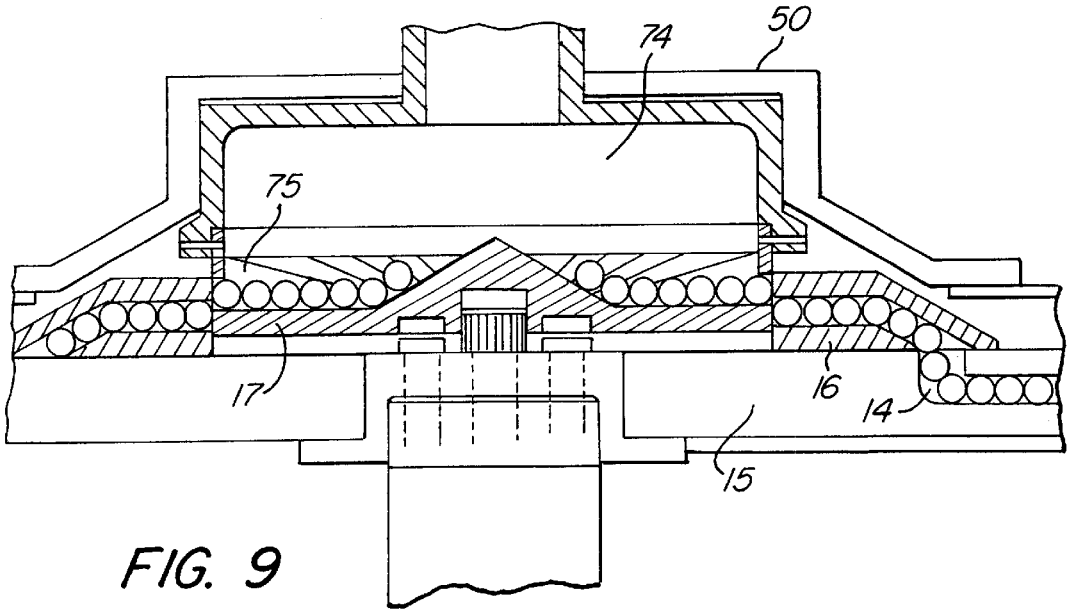
FIG. 9 shows the central feeding system disengaged from the disc to prevent further feeding of projectiles into the various channels.
Figure 10:
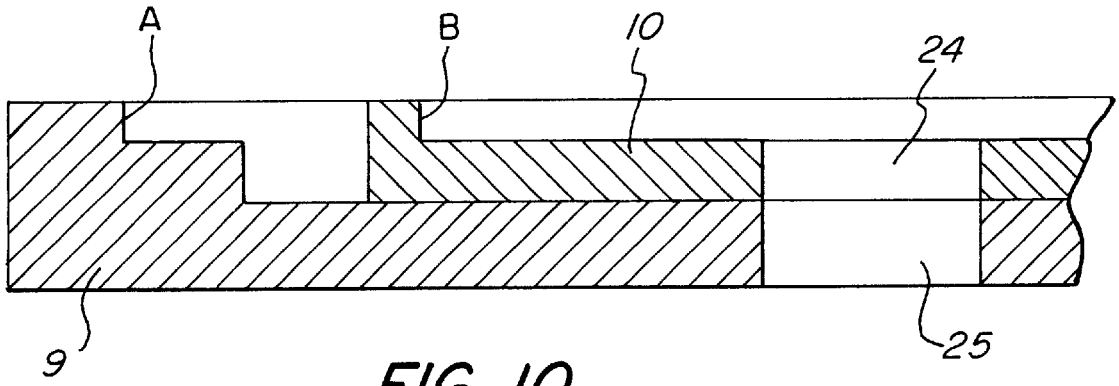
FIG. 10 shows the ring cams in the locking assembly.

Turning next to FIGS. 8 and 9, therein illustrated is an alternate embodiment of the weapon which utilizes a feed mechanism utilized with fixed tubes or channels 14 in the disc 15. As seen in FIG. 8, the feed mechanism 17 is engaged with the disc 15 so as to rotate therewith. Projectiles are dropped through the opening in the top of the housing 50 and into the feed mechanism chamber 74 from which they may flow outwardly through openings 75 into the feed passages 14 of the disc 15. In FIG. 9, the feed mechanism 17 has been moved upwardly so that the openings 75 in the receptacle are no longer aligned with the feed passages 14 and flow of projectiles is discontinued so that the disc is free to operate at high speed.

During the loading cycle with this embodiment, the control mechanism 61 can be utilized to slow the rotational speed of the disc 15 to facilitate the flow of the projectiles from within the feed device 17 and into the feed channels 14.

Figure 11:
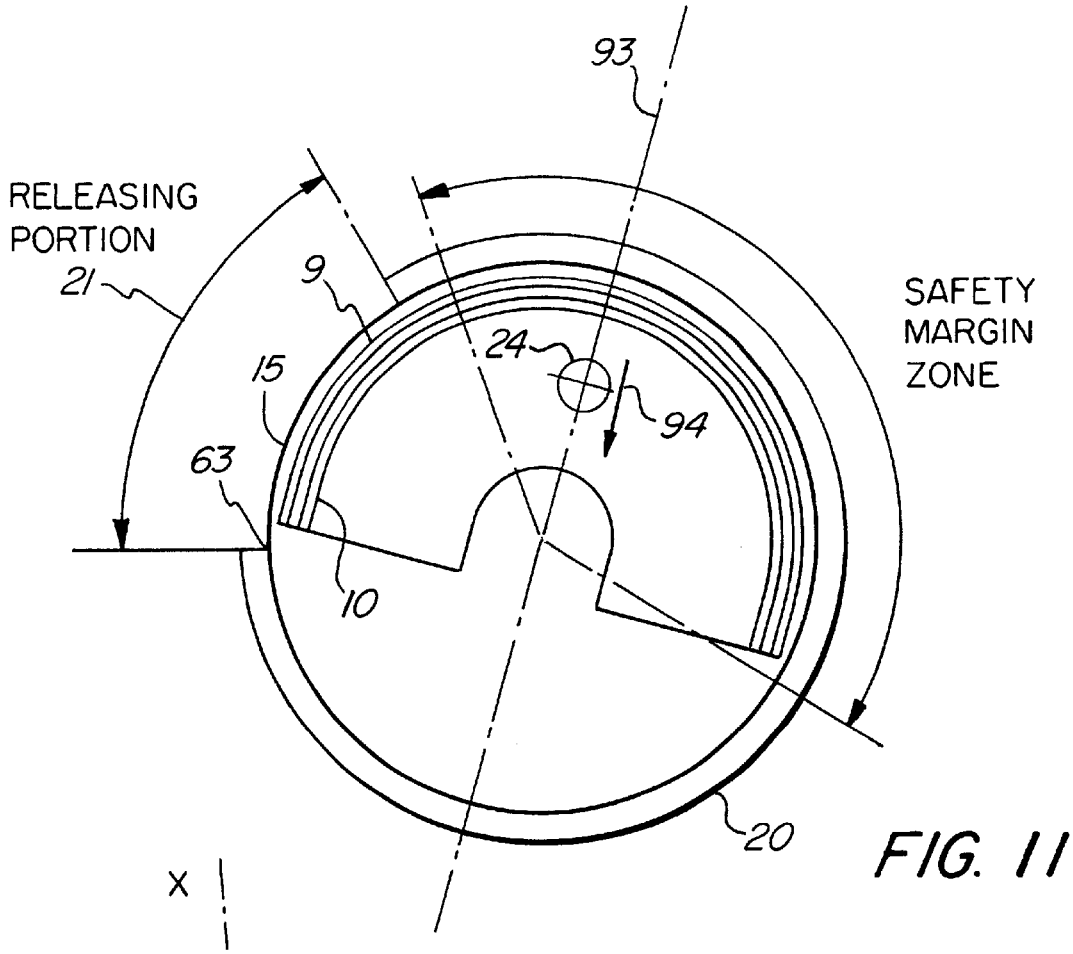
FIG. 11 diagrammatically shows the guide rail with its safety margin and releasing portions.
Figure 12:
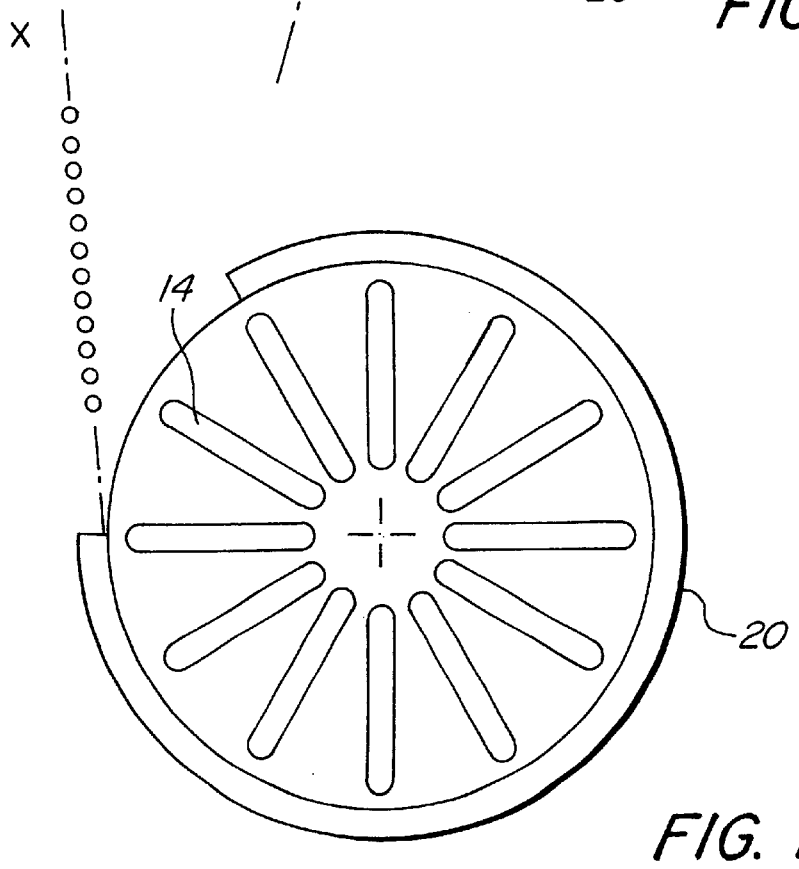
FIG. 12 is a similar diagrammatic view of the guide rail showing the discharge path of projectiles.

Turning now to FIGS. 11 and 12, the rail 20 extends over approximately 315° of the circumference of the disc 15 and is open at the portion 21 so that the projectiles may be released at this point and expelled from the weapon as shown at Point X in FIG. 12. As further shown in FIG. 11, the projectiles are released in the safety margin zone and travel in the rail 20 until they reach the releasing Point 63.

As also seen in FIG. 11, the rotary cams 9 and 10 are essentially stationary in terms of rotation, although they may radially to a limited extent. They occupy slightly more than 180° of the disc path. The passage 24 for the actuator 96 is also shown.

In operation of the illustrated embodiment, the weapon is pointed at the target and the switches 55, 56 are pressed causing the disc 14 and the actuator 96 to rotate. As the rotating cams 90, 91 of the actuator 96 bear upon the rotary cams 9, 10, the rotary cams 9, 10 in turn move the locking cams 7, 12 as seen in FIGS. 3 and 4 to discharge the outermost projectile in each of the feed channels 14 and the disc 15. The projectiles travel in the guide rail 20 until discharged as seen in FIG. 12. Because the actuator 96 driven by the stepper motor 92 cannot effect the relative movement of the rotary cams 9, 10 and locking cams 7, 12 so quickly as the disc 15 rotates, a number of revolutions will take place before projectiles are loaded at the outer stop position and others advanced to the two adjacent stop positions. Thus, the weapon will rapidly fire bursts equal to the number of radical feed passages 14.

As will be appreciated, every single projectile that is loaded in the feed channel is subject to the centrifugal forces generated by the high speed rotation of the disc. These forces assist the displacement of the locking rollers 8A, 8B and 8C to allow the free movement of the projectiles as they gradually move from position to position until ready to be released and discharged from the rotor. The locking cams and stops accurately position each projectile ready for discharge from the disc and there is no need for a synchronizing mechanism.

The guide rail release area allows the projectiles to be discharged one behind each other accurately. The guide rail portion at the end of 21 can be flexed if desired. This flexing can be timed with the rate of discharge so as to be able to hit separate targets simultaneously.

The embodiment of FIGS. 8 and 9 provides a magazine system capable of holding up to 9000 additional rounds. These can be loaded directly into the disc 15 while the disc is still rotating. The feeder has 20 outlets which align with the 20 feed channels.

This invention allows for either loading the rotor with pre-loaded magazines and or direct feeding of the rotor from the center feed system via a feeder 17 which is engaged to load directly into the rotor with an exact number of projectiles per channel.

In the embodiment of FIG. 2, the preloaded tubes can be quickly inserted into the feed passages 14 in the disc with the cover plate 53 removed. The tubes 70 slide onto or off the ends of the locking assembly 80. Moreover, automatic ejection of spent tubes may be an added feature.

Conventional machine guns using conventional cartridge cases can fire from 800 to 6000 rounds per minute in small bursts to save the ammunition and limit the time the barrels are actually in use to prevent rapid overheating of the barrels. Therefore, they are not able to engage what is known as sustained or saturation fire upon any target.

The present invention delivers more mass to the target in less time than conventional machine guns. When firing conventional rounds, there is a distance of approximately 100 feet between each projectile during flight. By using 20 discharge positions on the disc, this invention closes the gap from 100 feet to as little as four inches. Therefore, assuming the flight length of 20 rounds is six feet, eight inches, the combined mass of the 20 rounds exceeds the combined mass of the two rounds fired having a distance of some 100 feet.

Since heating is not a problem with this invention, it is capable of firing rates up to 240,000 rounds per minute in controlled bursts of 20 to 40 rounds.

Because the projectile released from the feed channel into the guide rail travels a relatively short distance, there is relatively little impact on the guide rail and it will have a relatively long life. In fact, engineering grade resins can be utilized for most of the assembly to facilitate manufacture and reduce cost and weight.

Thus, it can be seen from the foregoing detailed description and attached drawings that the weapon of the present invention provides rapid fire of projectiles using centrifugal force. There is no powder flash to expose the crew position and a large total projectile mass may be concentrated on the target in a highly controlled pattern.

Having thus described the invention, what is claimed is:

1. A weapon for centrifugally discharging projectiles at a rapid rate comprising:

(a) a housing;

(b) a disc having a multiplicity of feed channels extending radially therein and opening at the periphery of said disc, said feed channels receiving a multiplicity of projectiles and being configured to orient the projectiles in a single file adjacent the periphery of said disc;

(c) projectile locking means associated with each of said channels and located adjacent the periphery of said disc, said locking means including:

(i) a multiplicity of stops movable between a first position within said channel to preclude movement of the outermost projectiles outwardly of said channel and a second position removed from said channel to permit movement of a projectile thereby;

(ii) means for moving said stops between said first and second positions;

(d) means for actuating said moving means as said disc rotates to move the outermost stop into said second position and release the outermost projectile while the adjacent stop restrains the adjacent projectile, said actuating means thereafter releasing said adjacent stop to allow the next projectile to move outwardly until restricted by said first stop which was both moved into said first position thereof;

(e) a guide rail in said housing extending substantially about the periphery of said disc to receive projectiles being discharged from said channels, said guide rail having an opening therein to allow the projectiles entering thereinto to be discharged;

(f) motor means for rotating said disc; and (g) control means for said motor means.

2. The weapon in accordance with claim 1 wherein there are at least three stops in each channel to position three projectiles and said moving means releases the outermost projectile and allows the next two projectiles to move outwardly to the next stop.

3. The weapon in accordance with claim 1 wherein said stops are rollers movable in apertures communicating with said channel upwardly and downwardly between said first and second positions.

4. The weapon in accordance with claim 1 wherein said moving means includes at least one locking cam movable axially of said channel to effect movement of said stops between said first and second positions.

5. The weapon in accordance with claim 4 wherein said moving means includes cam members acting upon said locking cam.

6. The weapon in accordance with claim 1 wherein said actuating means is located at a point spaced from said opening in said guide rail to release said outermost projectile sequentially from said channels as the disc rotates thereby.

7. The weapon in accordance with claim 1 including replaceable tubes in said channels in which projectiles are preloaded.

8. The weapon in accordance with claim 1 wherein said disc has a feed aperture in its center, said feed channels extending between said feed aperture and the periphery of said disc, and wherein there is included a feed mechanism disposed above said feed aperture and having feed passages alignable with the channels in said disc for passage of projectiles into said feed channels.

9. The weapon in accordance with claim 8 wherein said feed mechanism is engageable with said disc to rotate therewith.

10. The weapon in accordance with claim 9 wherein said control means reduces the rotational speed of said motor and disc during feeding of projectiles into said feed channels.

* * * * *